United States Patent [19]

Greenberg

[11] Patent Number: 4,795,400

[45] Date of Patent: Jan. 3, 1989

[54] BRASSIERE STRAP

[76] Inventor: Bert Greenberg, 1201 S. Ocean Dr., Hollywood, Fla. 33019

[21] Appl. No.: 103,423

[22] Filed: Sep. 30, 1987

[51] Int. Cl.[4] ..... A41D 27/26

[52] U.S. Cl. ..... 450/86; 450/93; 21/268

[58] Field of Search ..... 2/267, 268, 338; 450/86, 93

[56] References Cited

U.S. PATENT DOCUMENTS

| | | | |
|---|---|---|---|
| 2,615,172 | 10/1952 | Donegan | 2/268 X |
| 3,112,494 | 12/1963 | Hardie | 2/338 X |
| 3,266,495 | 8/1966 | Sachs | 450/93 X |
| 3,295,529 | 1/1967 | Corrigall et al. | 450/86 |
| 4,638,513 | 1/1987 | Woods | 2/268 |

*Primary Examiner*—Werner H. Schroeder

*Assistant Examiner*—Jeanette E. Chapman

*Attorney, Agent, or Firm*—McAulay, Fields, Fisher, Goldstein & Nissen

[57] ABSTRACT

The present invention provides a brassiere strap having an elastic band attached to an elongate laminate band. The laminate band consists of a foam laminae between fabric inner and outer laminaes. The laminate band and the elastic band combination provides sufficient rigidity to prevent substantial bowing of the brassiere strap in response to longitudinal stresses of the strap and also provides sufficient flexiblity to permit the strap to conform to the configuration of the shoulder of a wearer. The combination of the laminate band and the elastic band form the shoulder portion of the brassiere strap to prevent irritation and indentation marks of the shoulder of a wearer.

9 Claims, 1 Drawing Sheet

BRASSIERE STRAP

FIELD OF THE INVENTION

The present invention relates to a brassiere strap, and more particularly, to a brassiere strap that incorporates a laminate band attached to an elastic band to prevent irritation and indentation marks from forming in the shoulder of the wearer.

BACKGROUND OF THE INVENTION

As is well known in the art, brassiere straps are connected, at opposite ends, to the cup of the brassiere and a rear panel of the brassiere. The brassiere is worn with the brassiere strap over the shoulder of the wearer. Thus, as can well be appreciated, the brassiere strap forms a tensile structural component of the brassiere that supports the cup of the brassiere. Such brassiere straps, especially in brassieres of larger size, tend to bow in response to longitudinal stresses in the straps, to cause indentation marks and irritation in the shoulder of the wearer.

The problem, as discussed above, has been addressed in the prior art by removable shoulder cushions. Such shoulder cushions can be fitted to the brassiere strap so that the padding of the cushion is located between the brassiere strap and the shoulder of the wearer. Problems are, however, encountered in wearing shoulder cushions. For instance, such shoulder cushions tend not to be stable on the brassiere strap and therefore, twist, so that the padding thereof becomes dislodged from under the brassiere strap. Additionally, such shoulder pads are sometimes visible when worn beneath tight fitting clothes. As can be appreciated, many wearers find this to be unattractive. Further, shoulder cushions present a further foundation garment to be worn, to thereby further complicate the process of assembling ones clothes and dressing.

Additionally, the prior art has provided shoulder straps having fibrous soft padding that is directly connected to the strap. Even when this is done the brassiere strap can bow when placed under a sufficient tension because the padding adds no rigidity to the assembled straps.

The present invention seeks to eliminate the irritation and indentation marks caused by brassiere straps and the associated problems encountered in wearing shoulder cushions. This is accomplished in the present invention by providing a brassiere strap having an elastic band connected to a laminate band, to provide sufficient rigidity to the strap, to prevent bowing in response to longitudinal stresses in the straps. Such a brassiere strap solves the prior art problems encountered with the use of shoulder pads by providing a brassiere strap having integrally formed padding.

SUMMARY OF THE INVENTION

The present invention provides a brassiere strap comprising an elastic band and an elongate laminate band. The elastic band has a pair of opposed first and second ends. The first end of the elastic band is adapted to be connected to the back portion of the brassiere. The elongate laminate band has a pair of opposed third and fourth ends. The fourth end is adapted to be connected to the front portion of the brassiere. The laminate band is attached to the elastic band and extends along the shoulder portion of the strap, with its fourth end adjacent to the second end of the elastic band, and its third end located between the first and second ends of the elastic band. The laminate band includes a foam laminae between a fabric outer laminae and an inner laminae formed of at least a ply of fabric. First and second cold adhesive layers seal the foam laminae to the outer and inner laminaes. The combination of the laminate band and the elastic band provides sufficient rigidity to prevent substantial bowing in response to longitudinal stress in the strap and provides sufficient flexibility to permit the strap to conform to the configuration of the shoulder of the wearer.

DESCRIPTION OF PREFERRED EMBODIMENT

Figure 1:
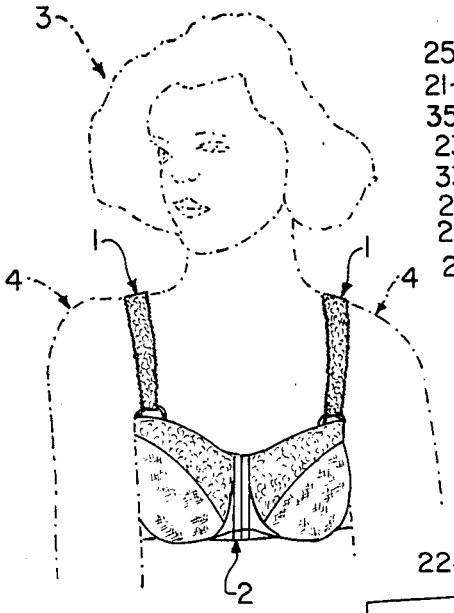
FIG. 1 is a front perspective view of the brassiere strap of the present invention connected to a brassiere worn on a wearer shown in phantom lines.
Figure 3:
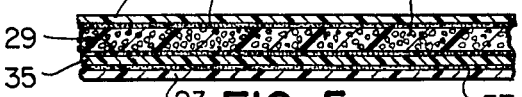
FIG. 3 is a cross-sectional view of the laminate band illustrated in FIG. 2 taken along lines 3—3 of FIG. 2.
Figure 5:
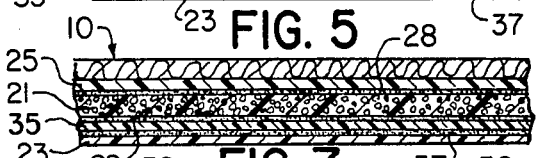
FIG. 5 is a cross-sectional view taken along lines 5—5 of FIG. 4.
Figure 9:
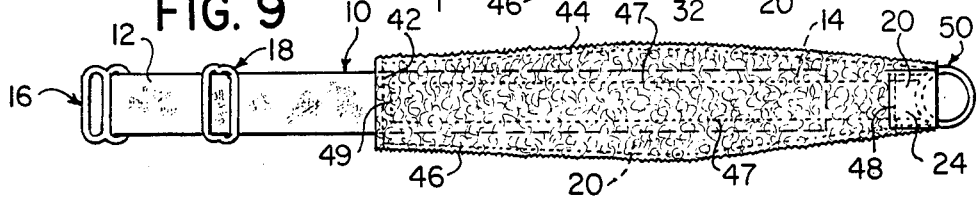
FIG. 9 is a top plan view of the preferred embodiment of the present invention illustrating the preferred method of attaching the brassiere strap to the front of the brassiere.

With reference now to FIG. 1, the brassiere strap 1 of the present invention is shown attached to a brassiere 2 worn by a wearer 3. As mentioned previously, conventional brassiere straps tend to dig into the shoulders 4 of the wearer causing irritation and unsightly indentation marks. This is particularly true in the larger sizes of brassieres. The present invention addresses this problem by incorporating an elongate laminate band 20, illustrated in FIG. 2. With reference to FIG. 3, the laminate band 20 consists of a foam laminae 21 located between an outer laminae 25, an inner laminae formed of at least a ply 23 of fabric and first and second cold adhesive layers 28 and 29 sealing the foam laminae 21 to the outer and inner laminaes. As can best be seen in FIGS. 4 and 6, an elastic band 10 is connected to the laminate band 20 to form the brassiere strap 1. With reference to FIG. 9, the laminate band 20 can be preferably attached to an eyelet 50 which is in turn connected to a front portion of the brassiere. The elastic band 10, in a manner well known in the art, can preferably be connected to the rear portion of the brassiere by being laced through a buckle 16 connected to the rear portion of the brassiere.

Having briefly described the subject invention, a more detailed description begins with a description of the elastic band 10. The elastic band 10 can be conventionally formed of a woven elastic material. Elastic band 10 has a pair of opposed first and second ends 12 and 14. The elastic band 10 is adapted to be connected by first end 12 to the rear portion of the brassiere by means of a slotted buckle 16. The first end 12 is conventionally looped through the slots of the buckle 16. Although not illustrated, the other side of the buckle 16 can be attached to a rear portion of the brassiere in a manner well known in the art. The first end 12 of the elastic band 10 can also be looped through an adjustable buckle 18 in a manner well known in the art to provide an adjustment in the length of the brassiere strap 1.

Figure 2:
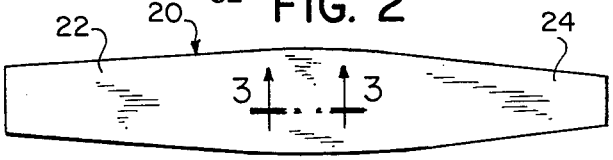
FIG. 2 is a top plan view of an elongate laminate band of the present invention.
Figure 4:
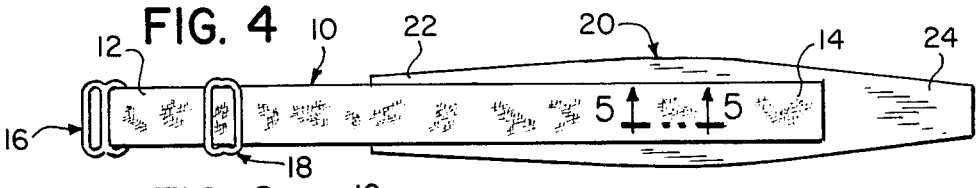
FIG. 4 is a top plan view of an elastic band of the present invention located over the elongate laminate band of the present invention.

With reference now to FIGS. 2 and 4, the laminate band 20 can have a pair of opposed third and fourth ends 22 and 24. The laminate band 20 is attached to the elastic band 10, forming the shoulder portion of the strap 1. That is, the elastic band 10 and the laminate band 20 longitudinally overlap to locate the fourth end 24 of laminate band 30 adjacent to the second end 14 of the elastic band 10. The third end 22 of the laminate band 20 is located between the first and second ends 12 and 14 of the elastic band 10.

FIG. 3 illustrates the structure of the elongate laminate band 20. A foam laminae 21 is provided to pad the assembled strap 1. The foam laminae 21 can be a polyurethane that preferably has a thickness of about 3.96 mm. The foam laminae 21 is located between a fabric outer laminae 25, which can be a nylon tricot, and an inner laminae that can be formed by at least a ply 23 of fabric. Brushed nylon is the preferred fabric for the inner laminae to provide a soft comfortable surface to bear against the skin of the wearer when the brassiere strap 1 is in use. The ply 23 preferably has a thickness of about 0.0254 mm and the outer laminae 25 preferably has a thickness of about 0.0254 mm. The foregoing described laminate band 20 is assembled with first and second cold adhesive layers 28 and 29 sealing the foam laminae 21 to the outer and inner laminaes. Additionally, the inner laminae can further include a ply 35 of fabric that can be provided between the foam laminae 21 and the inner laminae 23. Ply 35 can preferably be formed of a nylon tricot fabric having a thickness of about .0254 mm. In such case, a third cold adhesive layer 37 is used to attach the ply 35 to the ply 23. The purpose of ply 35 (as well as laminae 25) is to prevent the inevitable discoloration, known well in the art, of foam laminae 21 from showing through the laminate band 20. Cold adhesives, preferably acrylics, are used, rather than heat seals, to prevent initial discoloration of the foam laminae 21. The combination of the laminate band 20 and the elastic band 10 provides a sufficient rigidity to prevent substantial bowing in response to longitudinal stresses induced in the brassiere strap 1 by tensile loadings thereof.

Figure 7:
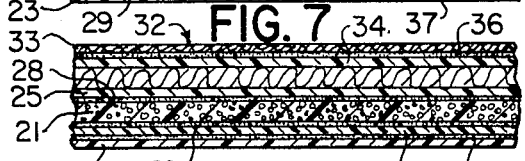
FIG. 7 is a cross-sectional view taken along lines 7—7 of FIG. 6.
Figure 6:
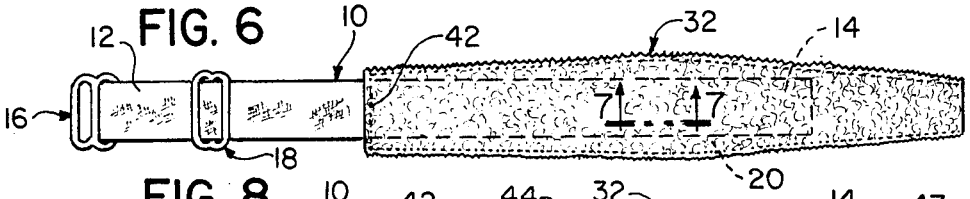
FIG. 6 is a top plan view of a lace band of the present invention located over the elastic band and laminate band of the present invention.
Figure 8:
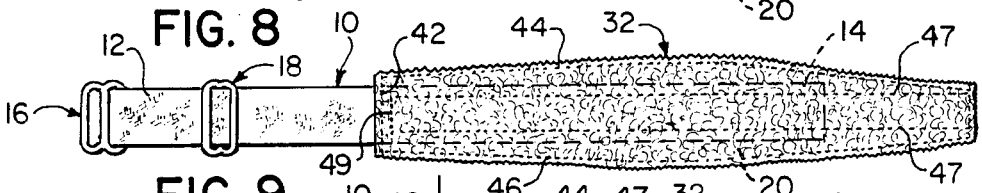
FIG. 8 is a top plan view of the preferred embodiment of the present invention.

With reference now to FIGS. 6 and 7, an elongate lace band 32 having a lace laminae 33 and a fabric backing laminae 34, which preferably can be a nylon tricot, can be attached to the outer laminae 25. The preferred thicknesses of the lace laminae 33 and the backing laminae 34 are each about 0.0254 mm. Laminae 34 is attached to laminae 33 by the preferred means of a fourth layer of cold adhesive 36. The lace band 32 covers the elastic band 10 along the length of the laminate 20 with backing laminae 34 against laminate band 20. That is, lace band 32 longitudinally overlies laminate band 20 and captures a portion of the elastic band 10 sandwiched therebetween. As would occur to one skilled in the art, the lace laminae 33 is selected to match the lace utilized in other portions of the brassiere. As a first step of assembly, lace band 32 is connected to laminate band 20, as illustrated by FIG. 6, by means of a first set of transverse stitches 42 located at the third end 22 of the laminate 20. The transverse stitches 42 also serve to connect the elastic band 10. Thereafter, as illustrated by FIG. 8, peripheral, edgewise stitches 44 and 46 can also be provided along the lengthwise edges of laminate 20 to further attach the lace band 32 to the laminate 20. The laminate 20 and lace band 32, thus envelop and conceal the elastic band 10. Further strength of the assembled brassiere strap 1 can be provided by the centrally located spaced, parallel pairs of lengthwise stitches, illustrated by 47. Stitches 47 extend along the length of the laminate band 20 and through the elastic band 10. For still more strength, a third set of transverse stitches 49 can be provided. Stitches 49 extend between stitches 47 and are located so as to be adjacent to the first set of transverse stitches 42. As illustrated in FIG. 9, the fourth end 24 of the laminae 20 can be folded over, against the lace band 32 and sewn in place by a second set of transverse stitches 48, extending between the pairs of stitches 47, to produce a loop that can preferably be used to attach an eyelet 50. Although not illustrated, as is well known in the art, eyelet 50 would be connected to the cup or in general, the front portion of the brassiere.

Figure 10:
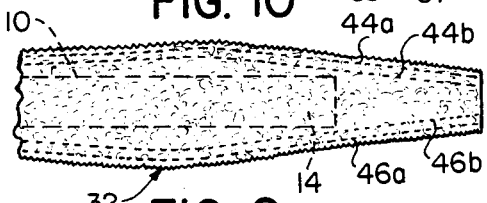
FIG. 10 is an enlarged fragmentary, top plan view of an alternative embodiment of the present invention.

The present invention can also include an embodiment, as illustrated by FIG. 10. In such embodiment, a single first set of transverse stitches 42 are used to attach the elastic band 10 to the lace band 32 and the laminate band 20. As shown in FIG. 10, the elastic band 10 is otherwise not connected to either the laminate band 10 and the lace band 32. In such embodiment, the band 32 is simply attached to laminate band 10 by an outer row of peripheral, edgewise stitches **44*a* and 46*a* and an inner row of peripheral, edgewise stitches 44*b* and 46*b*, inwardly spaced from respectively 44*a* and 46*a*. Additionally, another possible embodiment of the present invention could simply be the elastic band 10 and the laminate band 20 connected to one another. Such embodiment is not preferred, for aesthetic reasons, in that the elastic band 10 would be visible. Moreover, the foam laminae 21 would eventually yellow to discolor the uncovered laminate band 20**.

While specific embodiments of the invention have been shown and described, the invention should not be considered as limited. But as limited only as set forth in the appended claims.

I claim:

1. In a brassiere strap having a front end, a front portion, a shoulder portion, a back portion and a back end, wherein the improvement comprises:

an elongate elastic band having a front end and a back end, said back end of said elastic band constituting the back end of the brassiere strap and being adapted to be connected to the back of a brassiere, and an elongate, non-elastic, non-extensible, flexible laminate band having a front end and a back end, said front end of said laminate band constituting the front end of the brassiere strap and being adapted to be connected to the front of the brassiere, said elastic and laminate bands longitudinally overlapping and adhered to one another to provide the back portion of the brassiere strap which is solely a portion of said elastic band, and to provide the shoulder portion and the front portion of the brassiere strap which is composed of both said elastic band and said laminate band, said laminate band including a foam laminae between a fabric outer laminae and a fabric inner laminae, and also including first and second cold adhesive layers sealing said foam laminae to said outer and inner laminaes, whereby said combined laminate band and elastic band provide sufficient rigidity to prevent substantial bowing in response to longitudinal stresses in the brassiere strap, and also provide sufficient flexibility to permit the strap to conform to the configuration of the shoulder of a wearer of the brassiere.

2. The brassiere strap of claim 11 wherein said fabric outer laminae is nylon tricot and said fabric inner laminae is brushed nylon.

3. The brassiere straps of claim 2 wherein said fabric inner laminae further includes a ply of nylon tricot located between said foam laminae and said ply of brushed nylon, and a third cold adhesive layer sealing said ply of brushed nylon to said ply of nylon tricot.

4. The brassiere strap of claim 11 wherein said foam laminae is a polyurethane foam, and said cold adhesive is an acrylic.

5. The brassiere strap of claim 11 further comprising an elongate lace band formed of a laminate having a lace laminae and a fabric backing laminae attached to said lace laminae, said lace band longitudinally overlying and being attached to said laminate band with portions of said fabric backing laminae located against portions of said fabric outer laminae of said laminate band, the portion of said elastic band in the shoulder portion and the front portion of the brassiere strap being sandwiched between said lace band and said laminate band.

6. The brassiere strap of claim 11 wherein said foam laminae has a thickness of about 3.96 mm, said fabric outer laminae has a thickness of about 0.0254 mm, and said fabric inner laminae has a thickness of about 0.0254 mm.

7. The brassiere strap of claim 5 wherein said foam laminae is a polyurethane foam, said fabric outer laminae is a nylon tricot, said fabric inner laminae includes a ply of nylon tricot and a ply of brushed nylon, said fabric backing laminae is a nylon tricot, and said cold adhesive is an acrylic.

8. The brassiere strap of claim 8 wherein said foam laminae has a thickness of about 3.96 mm, and said fabric outer laminae, said plies of said fabric inner laminae, said lace laminae and said fabric backing laminae each have a thickness of about 0.0254 mm.

9. The brassiere strap of claim 5 wherein said front end of said laminate band and said overlying lace band are folded over to form a loop, said brassiere strap further comprising an eyelet received in said loop and adapted to connect the front end of said strap to the front of the brassiere.

* * * * *

UNITED STATES PATENT AND TRADEMARK OFFICE

CERTIFICATE OF CORRECTION

PATENT NO. : 4,795,400

DATED : January 3, 1989

INVENTOR(S) : Bert Greenberg

It is certified that error appears in the above-identified patent and that said Letters Patent is hereby corrected as shown below:

In each of Claims 2, 4, 5 and 6, line 1, change "11" to -- 1 --.

Signed and Sealed this

Thirteenth Day of June, 1989

*Attest:*

DONALD J. QUIGG

*Attesting Officer*

*Commissioner of Patents and Trademarks*